US006033328A

United States Patent [19]

Bellefleur et al.

[11] Patent Number: 6,033,328

[45] Date of Patent: Mar. 7, 2000

[54] HOCKEY STICK SHAFT

[75] Inventors: Alain Bellefleur, St. Luc; John Pagotto, Ville Mont-Royal, both of Canada

[73] Assignee: Sport Maska Inc., Westmount, Canada

[21] Appl. No.: 09/133,189

[22] Filed: Aug. 13, 1998

Related U.S. Application Data

[63] Continuation of application No. 08/743,119, Nov. 4, 1996, abandoned.

[51] Int. Cl.[7] ..... A63B 59/12

[52] U.S. Cl. ..... 473/561; 473/560

[58] Field of Search ..... 473/560–563

[56] References Cited

U.S. PATENT DOCUMENTS

| | | |
|---|---|---|
| 3,934,875 | 1/1976 | Easton et al. . |
| 3,972,528 | 8/1976 | McCracken . |
| 3,982,760 | 9/1976 | Tiitola . |
| 4,059,269 | 11/1977 | Tiitola . |
| 4,124,208 | 11/1978 | Burns . |
| 4,200,479 | 4/1980 | Ardell et al. . |
| 4,591,155 | 5/1986 | Adachi . |
| 4,684,130 | 8/1987 | Drolet et al. . |
| 4,689,130 | 8/1987 | Baum . |
| 4,968,257 | 11/1990 | Redekop . |
| 5,050,878 | 9/1991 | Deleris . |
| 5,217,221 | 6/1993 | Baum . |
| 5,333,857 | 8/1994 | Lallemand . |
| 5,407,195 | 4/1995 | Tiitola et al. . |
| 5,419,553 | 5/1995 | Rodgors . |
| 5,439,215 | 8/1995 | Ratchford . |

FOREIGN PATENT DOCUMENTS 1230898 of 0000 Canada .

*Primary Examiner*—Mark S. Graham
*Attorney, Agent, or Firm*—Robic

[57] ABSTRACT

A hockey stick handle having a pair of opposed narrow sides, a pair of opposed broad sides, a rear end, a forward end portion, and a longitudinal axis passing through said ends, the forward end portion being configured for engaging a blade. The handle has a longitudinally extending sandwich composite member. The sandwich member has three longitudinally extending substance zones. The substance zones has a rigid plastic foam spacer zone and two wood side zones. The side zones are spaced apart by the spacer zone. The three substance zones are configured and disposed such that each side zone individually faces a respective side of one of the pairs of opposed sides of the handle and such that together the two side zones and the spacer zone each face both of the sides of the other of the pairs of opposed sides of the handle.

16 Claims, 8 Drawing Sheets

HOCKEY STICK SHAFT

This application is a continuation of application Ser. No. 08/743,119 filed Nov. 4, 1996 now abandoned.

The present invention relates to game stick shafts and in particular to shafts or handles for use with hockey sticks or the like; such shafts include, for example, ice hockey sticks (including goalie sticks), street hockey sticks, ringuette sticks and the like. The present invention, by way of example only, will be described hereinafter in relation to an ice hockey stick.

Ice hockey sticks generally consist of two basic elements, namely an elongated handle component and a blade secured to the lower end of the handle.

A hockey stick handle or shaft which has a pair of opposed broad side faces and a pair of opposed narrow side faces is preferred by hockey players since such a shaft affords the user a relatively comfortable grip in addition to providing him with a certain degree of awareness of and control over the orientation of the blade at the end of the shaft.

It is also common for individual players to prefer a hockey stick having a particular set of characteristics relating to size, weight, etc. A handle or shaft for a hockey stick must, however, have a certain degree of rigidity so that the player has an acceptable level of "feel" while handling a puck or executing a shot.

A hockey stick must also be extremely strong in order for it to endure (for an acceptable period of time) the tremendous forces developed between it and a puck.

Hockey sticks are known which are made entirely out of strong lightweight metal (e.g. aluminum) or of strong synthetic materials; these may include composite blades comprising a fibre (e.g. glass) laminated core.

Traditionally, however, (ice) hockey sticks are made of one or more pieces (e.g. layers) of wood. A shortcoming of wooden handles is that they are generally not strong enough and thus do not hold up well under the usual conditions encountered when playing hockey.

A wooden hockey stick may, on the other hand, be reinforced with fibre (e.g. glass) fabric which is impregnated and bonded to the wooden surface with a synthetic resin. These types of reinforced wooden handles have given good results including good playing performance.

However, difficulties are still encountered in providing a relatively light weight handle for a hockey stick having the desired degree of rigidity or stiffness and yet provide a "feel" comparable to that of traditional wooden sticks when handling the puck and executing a shot.

For example, using the above mentioned known structure of a wood core and external fibre reinforced resin sheath, it is possible to obtain a stick shaft or handle for a hockey stick wherein the handle has a rigidity of 45 to 50 kilopoundals (kp); in such case the hockey stick comprising the handle and a blade may have an overall weight of about 630 to 690 gr; the rigidity measurement being taken as the force in kilopoundals necessary to deflect a the central point of a one meter span of a handle by 25 mm. A stick shaft or handle for a hockey stick having a superior rigidity (e.g. 65 to 70 kp) may also be obtained using the above wood-fibre structure but at the expense of a significantly increased overall weight for the hockey stick comprising a handle and blade (e.g. for an overall weight of 850 gr).

Accordingly, it would be advantageous to be able to provide an alternative composite handle construction for a hockey stick or the like which may be strong, durable, lightweight and of acceptable stiffness. It would, in particular be advantageous to be able to provide a wood based stick handle or shaft having a relatively high rigidity coupled with a relatively low weight.

STATEMENT OF INVENTION

The present invention generally provides in a hockey stick handle having a pair of opposed narrow sides, a pair of opposed broad sides, a rear end, a forward end portion, and a longitudinal axis passing through said ends, said forward end portion being configured for engaging a blade, the improvement wherein the handle comprises a longitudinally extending composite member, said composite member comprising two longitudinally extending substance zones, said substance zones comprising a wood zone and a rigid plastic foam zone, said substance zones being configured and disposed such that each zone individually faces a respective side of one of the pairs of opposed sides of the handle and such that together the zones each face both of the other pairs of opposed sides of the handle.

The present invention in one general aspect provides in a hockey stick handle having a pair of opposed narrow sides, a pair of opposed broad sides, a rear end, a forward end portion, and a longitudinal axis passing through said ends, said forward end portion being configured for engaging a blade, the improvement wherein the handle comprises a longitudinally extending sandwich composite member, said sandwich member comprising three longitudinally extending substance zones, said substance zones comprising a spacer zone and two side zones, said side zones being spaced apart by said spacer zone, said three substance zones being configured and disposed such that each side zone individually faces a respective side of one of the pairs of opposed sides of the handle and such that together the two side zones and the spacer zone each face both of the other pairs of opposed sides of the handle, said sandwich member being selected from the group consisting of a sandwich member comprising a wood spacer zone and two rigid plastic foam side zones and a sandwich zone comprising a rigid plastic foam spacer zone and two wood side zones.

The present in particular provides in a hockey stick handle having a pair of opposed narrow sides, a pair of opposed broad sides, a rear end, a forward end portion, and a longitudinal axis passing through said ends, said forward end portion being configured for engaging a blade, the improvement wherein the handle comprises a longitudinally extending sandwich composite member, said sandwich member comprising three longitudinally extending substance zones, said substance zones comprising a rigid plastic foam spacer zone and two wood side zones, said side zones being spaced apart by said spacer zone, said three substance zones being configured and disposed such that each side zone individually faces a respective side of one of the pairs of opposed sides of the handle and such that together the two side zones and the spacer zone each face both of the other pairs of opposed sides of the handle.

Generally, in accordance with another aspect of the present invention, there is provided in a game stick comprising an elongated handle component and a blade component, said elongated handle component comprising a pair of opposed narrow sides, a pair of opposed broad sides, a rear end, a forward end portion, and a longitudinal axis passing through said rear end and said forward portion, said blade component being attached to the forward end portion of said handle component, the improvement wherein the handle comprises a longitudinally extending sandwich composite member, said sandwich member comprising three longitudinally extending substance zones, said substance zones comprising a spacer zone and two side zones, said side zones being spaced apart by said spacer zone, said three substance zones being configured and disposed such that each side zone individually faces a respective side of one of the pairs of opposed sides of the handle and such that together the two side zones and the spacer zone each face both of the other pairs of opposed sides of the handle, said sandwich member being selected from the group consisting of a sandwich member comprising a wood spacer zone and two rigid plastic foam side zones and a sandwich zone comprising a rigid plastic foam spacer zone and two wood side zones.

The sandwich member of the present invention will, hereinafter, be described, by way of example only, more particularly in relation to a sandwich member comprising a rigid plastic foam spacer zone and two wood side zones. The following will of course apply in analogous fashion to a sandwich member comprising a wood spacer zone and two rigid plastic foam side zones, to a composite member comprising two substance zones, etc.

In accordance with the present invention reinforcing means may, if desired or necessary, be sheathed about a sandwich member (see below).

As mentioned above, a sandwich member may comprise a rigid plastic foam spacer zone and two wood side zones. The sandwich composite member may, in addition to the above mentioned two wood side zones and the intermediate rigid foam spacer zone, comprise additional (wood/foam) substance zones (e.g. additional alternating (wood/foam) substance zone), i.e. the sandwich member comprises at least the above mentioned three substance zones. The sandwich composite member may, however, of courses, as desired consist of the above mentioned three substance zones.

The substance zones themselves may, as desired, comprise one or more types of materials of specified substance, e.g. wood, or rigid foam. A wood side zone may, for example, be of a single more or less homogenous wood material, e.g. be of wood of a single species. A wood zone may be a laminate or other type of wood composite comprising two or more wood layers or elements fixed (e.g. glued) together and which may be of the same or different wood species. A wood side zone may, for example, be made up from poplar, aspen, birch, balsa, etc. Advantageously a wood side zone may be a unitary element of a single more or less homogeneous wood material, i.e. to simplify construction of the handle. The wood side zones may be the same or different in relation to their materials of construction and/or configuration. The grain of the wood material may for example be disposed so as to be parallel to or at an angle of less than 90 degrees to the longitudinal axis of the handle.

A rigid foam spacer zone may, for example, likewise be of a single more or less homogenous rigid foam material, i.e. of a single species or type of rigid expanded plastics material. The foam zone may alternatively, if desired, be of any suitable heterogeneous plastic material. Alternatively, as in the case of a wood side zone, the rigid foam spacer zone may be of a plurality of different foam materials fixed (e.g. glued) together as layers, adjacent segments, etc.; advantageously the rigid foam spacer zone may be of a unitary element of a single more or less homogeneous expanded plastics material, i.e. to simplify construction of the handle.

A substance zone may be of continuous type or broken type. For example, the spacer zone may be obtained from a foam member which is a more or less continues flat strip, plate or block with uninterrupted surfaces (i.e. of continuous type). Alternatively, the substance spacer zone may be of broken type derived from one or more members having surfaces interrupted by grooves, openings, and the like, i.e. the spacer member may be made up from a body having a waffle, honey comb or similar type of structure; the spacer foam zone may simply be of a plurality of spaced apart members; etc.

The outer wood side zones may be of a relatively high density wood material whereas the rigid foam spacer zone may be of a relatively low density material. Thus, the rigid foam spacer zone material may, for example, have density of from 60 to 180 kilograms per cubic meter. On the other hand, the side zone material may, for example, have density of from 350 to 480 kilograms per cubic meter.

In any event, the wood zones and the intermediate spacer zone of the sandwich member are of course to be configured and to be made up of materials which provide the handle with the desired degree of stiffness coupled with a desired degree of weight (e.g. to provide a hockey stick comprising a handle and blade wherein the handle has a relatively high stiffness and the overall weight of the hockey stick is relatively low). If the handle optionally, includes sheath reinforcing means the material of the sheath reinforcing means are also selected with an eye to provide a hockey stick which has a handle which has a relatively high stiffness and wherein the overall weight of the hockey stick is relatively low. For example, the hockey stick may have an overall weight of 600 gr to 675 gr while the handle thereof has a rigidity or stiffness of 60 kp to 75; the blade contributing for example from 130 to 150 gr to the overall weight. More particularly the hockey stick may have an overall weight of 615 gr and a handle with a stiffness of 75 kp.

In accordance with the present invention the side zones may as desired or necessary be disposed so as to face either the pair of broad sides or alternatively the narrow sides of the handle.

Thus in accordance with the present invention each side zone may face a respective broad side of the pair of opposed broad sides and the two side zones and the spacer zone may each face both narrow sides of the pair of narrow sides of the handle.

Alternatively, each side zone may face a respective narrow side of the pair of opposed narrow sides and the two side zones and the spacer zone may each face both broad sides of the pair of broad sides of the handle.

The substance zones may of course take on any desired (e.g. cross sectional) configuration. The sandwich member, in a cross sectional plane perpendicular to the longitudinal axis of the handle (i.e. cross sectional profile), may, for example, have a more or less four sided polygonal form (e.g. a more or less rectangular form). Each of the substance zones may likewise have a cross sectional form in the same such plane which may also be a more or less four sided polygonal form (e.g. a more or less rectangular form). The spacer zone for example may have a thickness dimension in a first cross sectional direction of from 8 mm to 10 mm and a width dimension in a second cross sectional direction of from 23 mm to 28 mm; each of the side zones independently may have dimension in the said first cross sectional direction of from 4 mm to 6 mm and a dimension in the said second cross sectional direction of from 23 mm to 28 mm.

The cross sectional dimensions, of the sandwich member as a whole and/or of each of the zones, perpendicular to the longitudinal axis of the handle may be more or less constant in the first thickness and second width directions over at least a part of the longitudinal length of the sandwich member. Alternatively, these dimensions may vary over the length of the handle or shaft. For example, the side zones and the spacer zone may configured and disposed such that the spacer zone has a longitudinally extending wedge like shape. Thus, for example, the spacer zone may diminish in thickness in the direction from the forward end toward the rear end or vice-versa.

A handle in accordance with the present invention may have a forward end which is tapered for engaging a shank of a blade for forming a hockey stick (see for example U.S. Pat. No. 5,407,191, the entire contents of which are incorporated herein by reference). In this case the dimensions of the side and/or spacer zones in the first and/or second directions may gradually diminish from some initial value to some relatively lower or smaller value, the smaller value being at the tip of the forward end. The sandwich member, may for example, in the area of the tapered forward end have a spacer zone of more or less constant cross sectional dimensions in the first thickness direction and second width direction; however, while the width dimension of the outer side zones may remain more or less constant, the thickness dimension of the outer side zones may gradual diminish from some initial value to some smaller value (i.e. the sandwich member tapers at the forward end in one dimension only (e.g. in the thickness dimension). The side zones may taper right up to the interface with the intermediate spacer zone, i.e. for attaching the forward end to a blade (i.e. as described in U.S. Pat. No. 5,407,191).

The spacer zone may be of any suitable (known) open or closed cell rigid foam material. It is to be kept in mind, however, that a rigid foam material is one that is able to resist compression, i.e. is compression resistant in relation to the compressive forces to which a handle may be subjected during play. The spacer zone may comprise a foam material which may for example have a modulus of elasticity (MPA=megapascal) of from 100 to 380 MPA (i.e. 15,000 to 55,000 pounds per square inch). The spacer zone material may, for example, have density of from 60 to 180 kilograms per cubic meter. The rigid foam material may for example be a closed cell polymethacrylimide rigid foam; such a foam is available under the trade designation ROHACELL, from Rohm, Darmstadt, Germany.

The foam material may be obtained in a bulk sheet type format requiring that it be cut into a strip of the desired configuration for incorporation into a handle; as may be appreciated the wood for the wood zones may have to be similarly worked.

The side zones, as mentioned above, may each be made up of any suitable wood material such as for example from poplar, aspen, birch, balsa, etc. The wood material may, for example, have a modulus of elasticity (MPA=megapascal) of from 7,500 MPA to 11,800 MPA (e.g. 1,100,000 to 1,700,000 pounds per square inch). The side zone material may, for example, have density of from 350 to 480 kilograms per cubic meter.

The materials or substances of the zones may be attached or fixed to each other in any suitable or desired manner, e.g. using an adhesive material such as for example an epoxy resin.

Each of the zones may occupy any desired percentage of the volume of the sandwich member, i.e. with a view to the provision of a hockey stick having a relatively low weight and a handle of relatively high rigidity.

When the spacer foam zone is disposed so as to face upon the narrow sides of the handle the foam zone may, for example, represent up to from 40% to 55% of the volume of the sandwich member; the side zones may together occupy a volume of 60% to 45% of the sandwich member. The spacer zone may occupy a volume which is larger or smaller than the combined volume of the side zones. In the case wherein the outer side zones are symmetrically disposed on either side of the spacer zone, each of the side zones may have more or less the same volume, e.g. each side zone may have a volume in the range of from 30% to 22.5% of the sandwich member (e.g. each side zone may have a volume of 30%). Alternatively, the side zones may be disposed asymmetrical about the spacer zone i.e. one of the side zones may occupy a volume which is different from that of the other side zone. The side zones for an asymmetrical disposition may, for example, each occupy a volume of 20% or more of the sandwich member. For an asymmetrical disposition, one of the side zones may thus, for example, occupy 25% of the volume of the sandwich member while the other side zone may occupy 35% of the volume of the sandwich member.

On the other hand when the foam zone is disposed so as to face upon the broad sides of the handle the foam zone may represent up to from 55% to 70%; the side zones may together occupy a volume of 45% to 30% of the sandwich member. The spacer zone in this case may also occupy a volume which is larger or smaller than the combined volume of the side zones. The side zones may, for example each also occupy the same or different volume; the side zones may, for example, each occupy a volume of 20% or more of the sandwich member.

If present, any reinforcing means sheathed about the sandwich member may take on any desired or necessary form and be made of any desired materials. However, the construction of the reinforcing means advantageously should be selected with a view to obtaining a handle having a relatively high rigidity and a relatively low weight, e.g so as to modify (e.g. reinforce) in a desired or suitable fashion the strength or rigidity characteristics of the handle. Thus for example the reinforcing means may comprise one or more (e.g. two) layers of unidirectional fibres (e.g. unidirectional glass and/or unidirectional carbon fibres) in a resin (e.g. epoxy resin), the fibres being disposed more or less parallel to the longitudinal axis of the handle.

It is to be understood herein, that if a "range" or "group of substances" is mentioned with respect to a particular characteristic (e.g. wood, foam, thickness, width, density and the like) of the present invention, the present invention relates to and explicitly incorporates herein each and every specific member and combination of sub-ranges or sub-groups therein whatsoever. Thus, any specified range or group is to be understood as a shorthand way of referring to each and every member of a range or group individually as well as each and every possible sub-ranges or sub-groups encompassed therein; and similarly with respect to any sub-ranges or sub-groups therein.

In drawing which illustrate example embodiments of the present invention:

In the following discussion of the figures, the same reference numerals will be used to designate the same elements.

Figure 1:
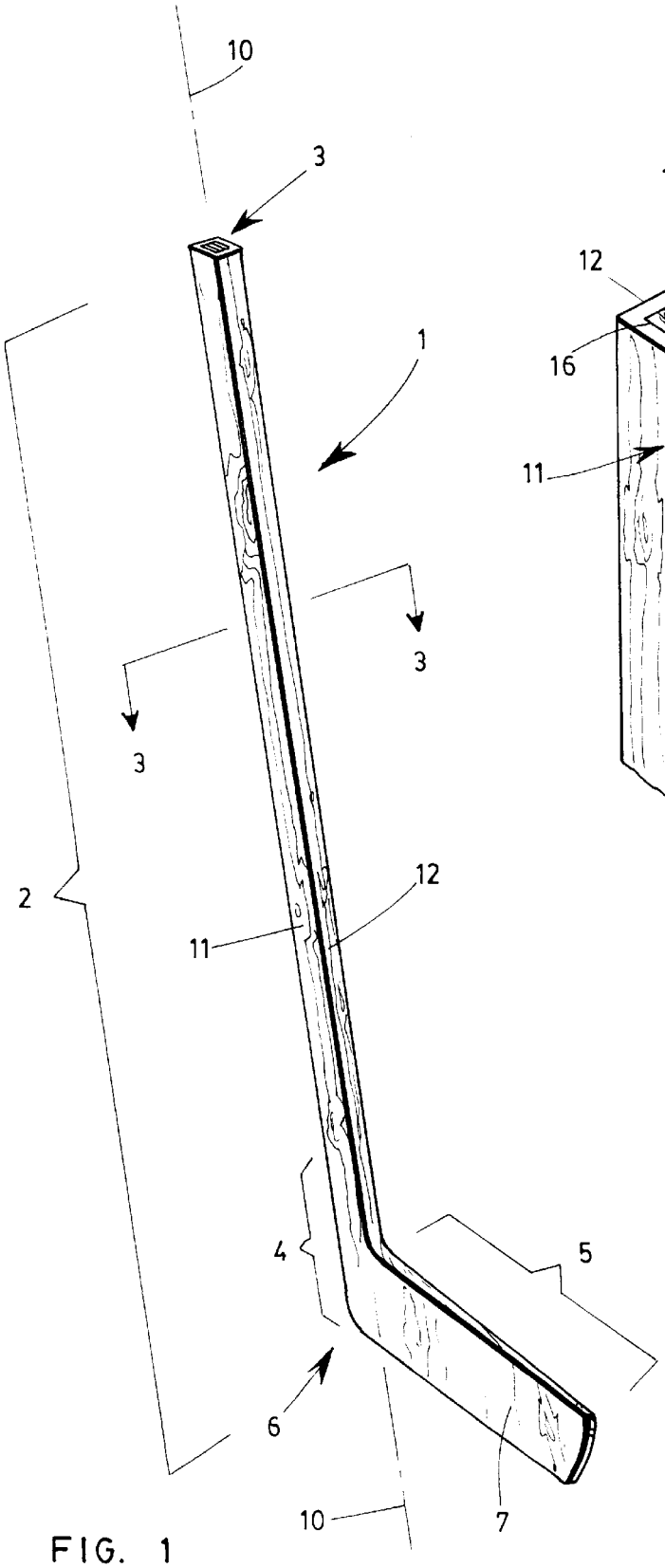
FIG. 1 is a schematic perspective view of an example hockey stick in accordance with the present invention.

FIG. 1 illustrates an embodiment of a hockey stick 1 in accordance with the present invention. The hockey stick 1 has a handle component generally designated by the reference numeral 2. The handle component 2 has a rear end 3 and a forward end portion 4. The overall length of the handle component 2 may, for example, be in the range of from about 1100 to 1650 mm (e.g. about 1540 mm); the length could of course be shorter or longer as desired or necessary.

The hockey stick 1 also has a blade component 5. The blade component is attached to the forward end portion 4 of the handle component 2 at the heel 6 of the stick; the blade component 5 may be attached to the forward end portion 4 in any suitable (known) fashion (e.g. by a fibre reinforced plastics material layer(s)). The blade component 5 is straight and has more less planar broad front and rear faces. One of the blade faces is designated by the reference numeral 7; the other face is hidden there behind. The blade could of course take on a curved aspect in which case the broad blade face 7 could for example have a convex aspect and the hidden broad blade face a corresponding concave aspect.

The handle component is an elongated member and has longitudinal axis 10. The handle component 2 has a rectangular like configuration (i.e. viewed in cross-section, the shaft 2 provides a more or less rectangular aspect or profile—see, for example FIGS. 2 and 6). Accordingly, the handle component 2 has a pair of opposed broad sides 11 and a pair of opposed narrow sides 12. As illustrated the broad and narrow faces are shown as having a planar aspect but they may of course have a curved aspect if so desired (e.g. convex or concave aspect—see for example U.S. Pat. No. 5,423,531, the entire contents of which are incorporated herein by reference).

The handle component 2 comprises a longitudinally extending structural core component. The handle component 2 also has an outer sheath component which is longitudinally sheathed or disposed about the core component, i.e. the sheath component is disposed about or surrounds the core component over at least a portion of the length of the core component.

The core component comprises a longitudinally extending sandwich member. The sandwich member comprises three longitudinally extending substance zones, namely two wood side zones 15 and 16 and a central or rigid foam spacer zone 17. Referring to FIG. 3, these substance zones are shown in cross sectional profile; these same zones may also be seen in FIGS. 2 and 4 to 6. The foam spacer zone 17 as may be appreciated spaces apart the two wood side zones 15 and 16, i.e. transversely relative to the longitudinal axis 10 of the handle component 2.

The sandwich member may, for example, be configured so as to have a length whereby it may extend from the rear end 3 and include the front end portion 4 of the handle component 2. Alternatively, the sandwich member may be configured so as to only extend over a portion of the length of the handle component 2. For example, the sandwich member may be configured so as to extend from the rear end 3 to some position intermediate the rear end 3 and the front end portion 4; the sandwich member may, alternatively, for example, be configured so as to be some distance from both the rear end 3 and the front end portion 4.

Figure 4:
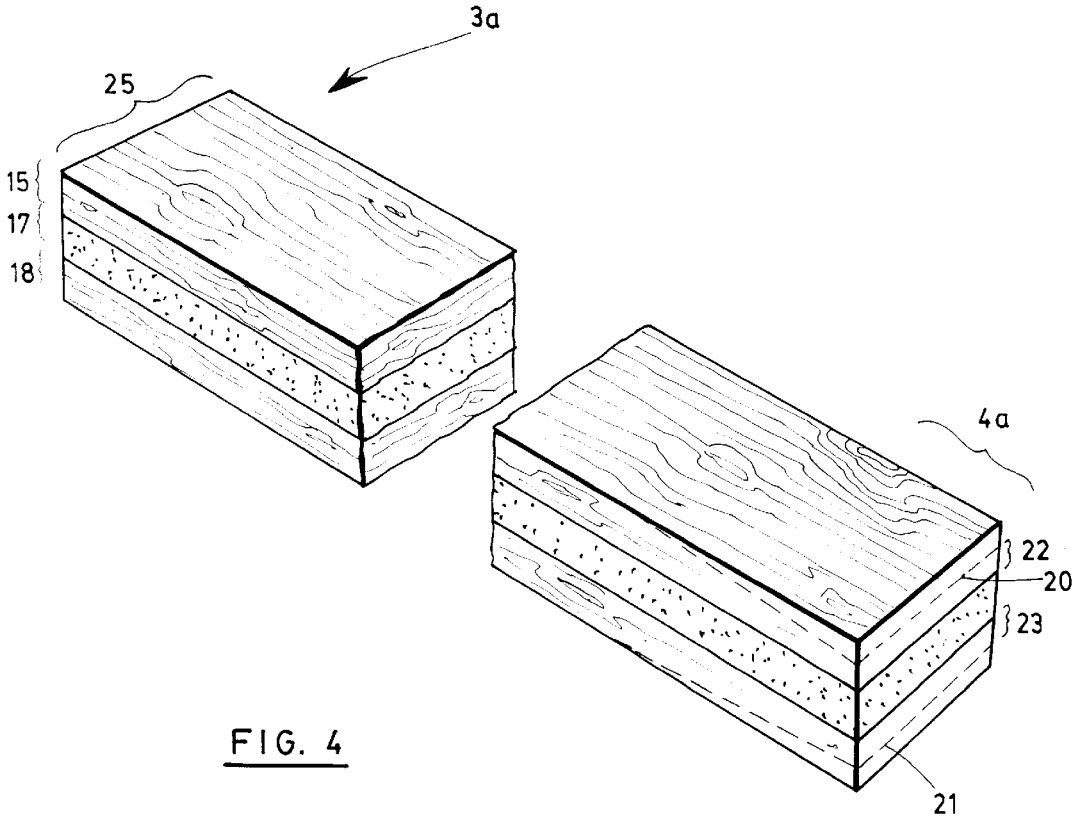
FIG. 4 is a schematic perspective side view of an example embodiment of a sandwich member in accordance with the present invention.

Referring to FIG. 4, this figure shows a sandwich member which is configured to extend from the rear end and include the front end portion of the handle component. The sandwich member has a rear end 3*a* and a forward end portion 4*a*; the rear end 3*a* is intended to form part of the rear end 3 of a handle component. The sandwich member has a more or less constant cross sectional profile from the rear end 3*a* up to and including the forward end portion 4*a*. This type of sandwich structure member may, for example, be used for a handle component wherein the forward end portion is intended to be configured for replaceably engaging in known manner the socket of a shank element of a replaceable blade component, i.e. the sandwich member may be used for forming a hockey stick of different form than that shown in FIG. 1 wherein the handle and blade are unitary and fixed to each other.

Alternatively, the wood side zones of the forward end portion 4*a* may be shaved as by sanding or with a plane so as to remove a portion of the wood of each side zone to an inclined level designated by the dotted lines 20 and 21. The result is a tapered end portion wherein the thickness of the outer side zones decrease to thickness 22 and 23 which is smaller than the thickness of the side zones in the rest of the sandwich member; the cross sectional profile of the sandwich member otherwise stays rectangular across the tapering forward end portion.

Figure 5:
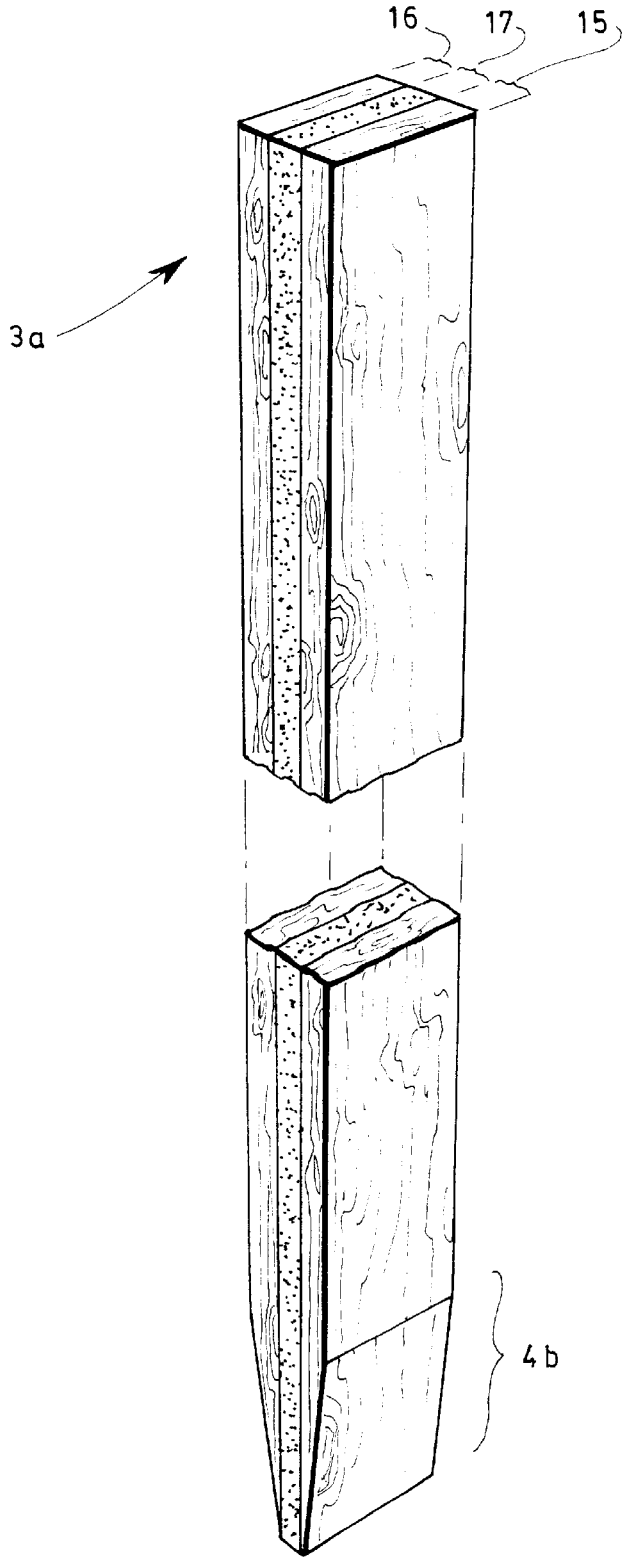
FIG. 5 is a schematic perspective side view of a modified version of the sandwich member shown in FIG. 4.

In other words, referring to FIG. 5 which shows an example of such a modified sandwich member, the side zones are worked so as to taper inwardly to the terminal forward part of the sandwich member so as to give a forward end portion 4*b* having a wedge like aspect. The sandwich member thus has a more or less constant cross sectional profile from the rear end 3*a* up to the forward end portion 4*b*, i.e. not including the forward end portion 4*b*. This type of wedged sandwich member may for example be used to form a handle as shown in FIG. 1 (see FIG. 10 as well as U.S. Pat. No. 5,407,195).

In any case as may be seen from FIGS. 4 and 5, the substance of the foam spacer zone 17 in the example embodiments shown in these figures is composed in its entirety of a single body of rigid foam extending from the rear end to the forward end portion. Similarly, the substance of the wood side zones 15 and 16 in the example embodiments shown in these figures are each composed in their entireties of a single body of wood extending from the rear end to the forward end portion. The bodies may be unitary in the sense of being obtained from (e.g. cut out from) a single piece of foam or wood or they may be composed of a plurality of pieces of foam or wood suitably fixed (e.g. glued) together as the case may be (i.e. be a composite foam or wood material). Although the bodies of foam and wood are shown as being more or less continuous they may be discontinuous or broken e.g. the bodies may be interrupted for example by openings or spaces. Thus, for example, one or more of the zones (e.g. the rigid foam spacer zone) may have a waffle or honey comb like configuration; see FIG. 15 which shows an example honey comb spacer body for a spacer zone.

Referring back to FIG. 3, this figure shows a cross sectional profile of the sandwich member (i.e. perpendicularly to the length of the sandwich member). The zones are shown as having a common width 25. The side zones 15 and 16 are also shown as having thicknesses 26 and 27 which are also more or less the same. The spacer zone 17 has a thickness 28 which is larger than the individual thickness of either of the side zones. The combined thicknesses of the zones defines the thickness of the sandwich member. In the case of the sandwich member shown in FIG. 4 the thicknesses of each zone will as may be understood be more or less constant over the length of the sandwich member, i.e. so as to give the sandwich member a more or less constant thickness over its entire length. In the case of the sandwich member shown in FIG. 5 the thicknesses of the side zones in the forward end portion 4*b* decreases towards the terminal end of the forward portion of this sandwich member, i.e. the thickness of the sandwich zone is not constant over its entire length. Alternatively, the thickness of each of the zones may, for example, be varied so as to provide the spacer zone with a longitudinally extending wedge like configuration wherein the thickness of the spacer zone diminishes towards the rear end, e.g. in addition to a wedgelike shape at the forward end; see FIGS. 11, 12 and 13.

Figure 2:
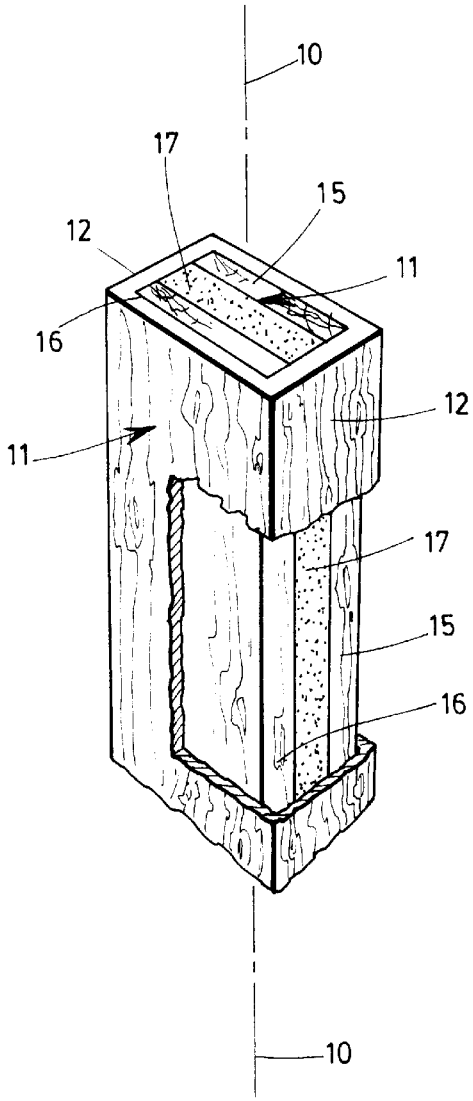
FIG. 2 is a schematic perspective view along the longitudinal axis of the handle of a portion of the handle shown in FIG. 1 with the outer reinforcing sheath partially cut away.
Figure 3:
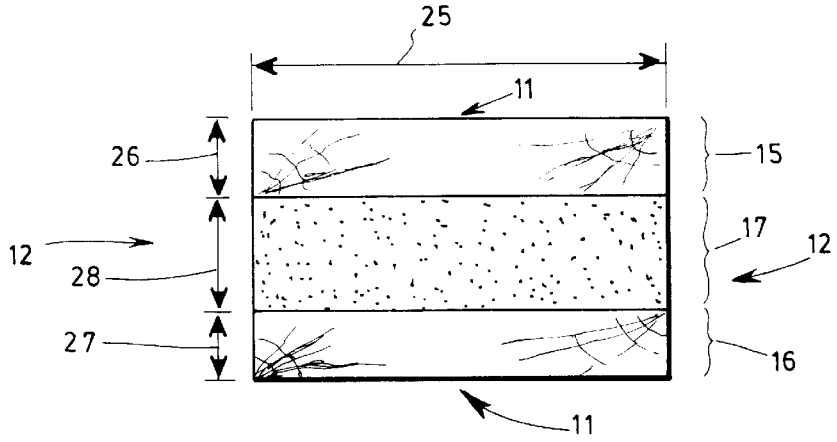
FIG. 3 is a cross sectional view of the handle taken along lines 3—3 of FIG. 1 but with the outer reinforcing sheath removed so as to expose only the cross sectional profile of the sandwich member thereof.
Figure 6:
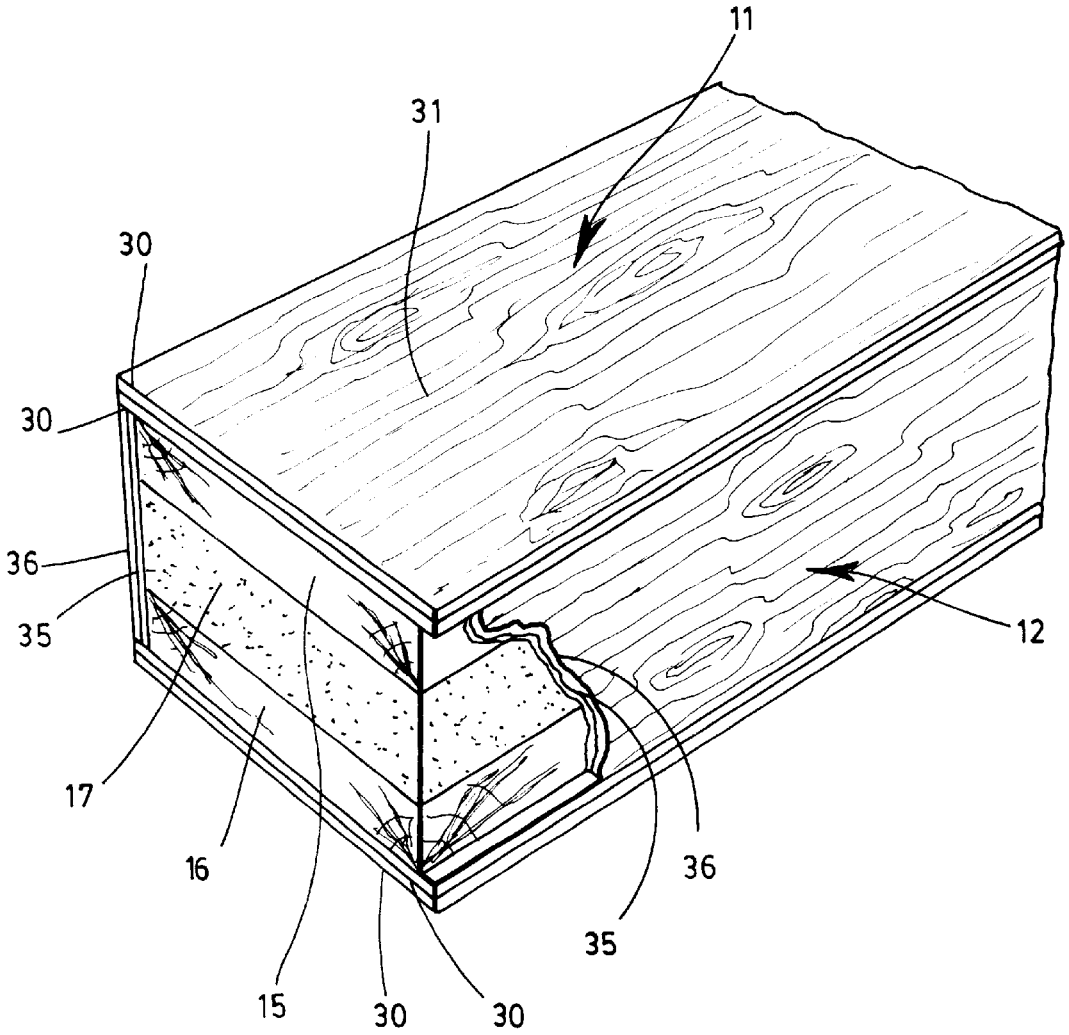
FIG. 6 is another schematic perspective view, along the longitudinal axis, of the portion of the handle shown in FIG. 2, FIG. 6 being on the same page of drawings as FIG. 2.

A sandwich member such as shown in FIGS. 2, 3 and 6 (as well as in FIGS. 4 and 5) has a pair of opposed broad sides and a pair of opposed narrow sides. The side zones each on their respective own (i.e. individually) define a respective broad side of the sandwich member, i.e. the side zones each face a corresponding broad side of the handle component. Similarly, the side zones and the spacer zone together define each of the narrow sides of the sandwich member, i.e. the side zones and the spacer zone together each face the corresponding narrow sides of the handle component.

The various materials or substances of the zones of the sandwich member may be fixed or held together in any suitable fashion; the materials may for example be attached together as by glue, bonding resin or any other type of suitable (known) adhesive); e.g. by any suitable (known) epoxy resin adhesive substance.

The faces of the broad and narrow sides of the handle component shown in FIGS. 1, 2, and 6 are defined by the outer sheath component. If desired, however, the sandwich member need not be covered by such a sheath (e.g. one or more sides thereof need not be so covered). However, such a sheath may be used so as to modify (e.g. reinforce) in a desired or suitable fashion the strength or rigidity characteristics of the handle as well as to facilitate sanding and/or provide an aesthetic quality to the handle.

Referring to FIG. 6, the sheath component for the handle component of FIG. 1 is a composite reinforcing means which comprises a number of strengthening or stiffening layers and as desired aesthetic sandable wood veneer layers. Thus the sandwich member may be longitudinally covered on the broad sides thereof by two layers 30 of unidirectional glass/carbon fibres in a resin (e.g. epoxy resin) such as obtainable from FIBRES ARMTEX INC. MAGOG QUEBEC CANADA. The unidirectional fibres are shown as lines one of which is designated with the reference numeral 31. The narrow sides may be covered by a layer 35 of unidirectional glass and/or carbon fibres in a resin (e.g. epoxy resin) such as obtainable from FIBRES ARMTEX INC. The glass and/or carbon fibre layer 35 on the narrow sides may be covered by a thin layer of birch wood 36 for facilitating sanding as well as for aesthetic purposes. The various layers are fixed to the sandwich member in any suitable fashion (e.g. glue, bonding resin or any other type of suitable (known) adhesive); if desired the outer surface may be covered by a suitable resin provided that the desired weight/strength characteristics are obtained.

Figure 7:
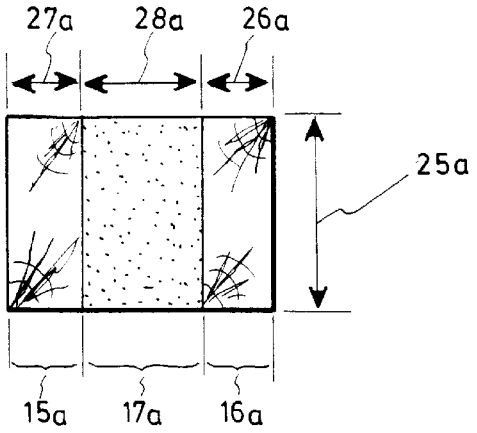
FIG. 7 is the same view as shown in FIG. 3 but of another embodiment of the invention wherein the side zones and the spacer zone face both of the broad sides of the handle rather than the narrow sides.
Figure 8:
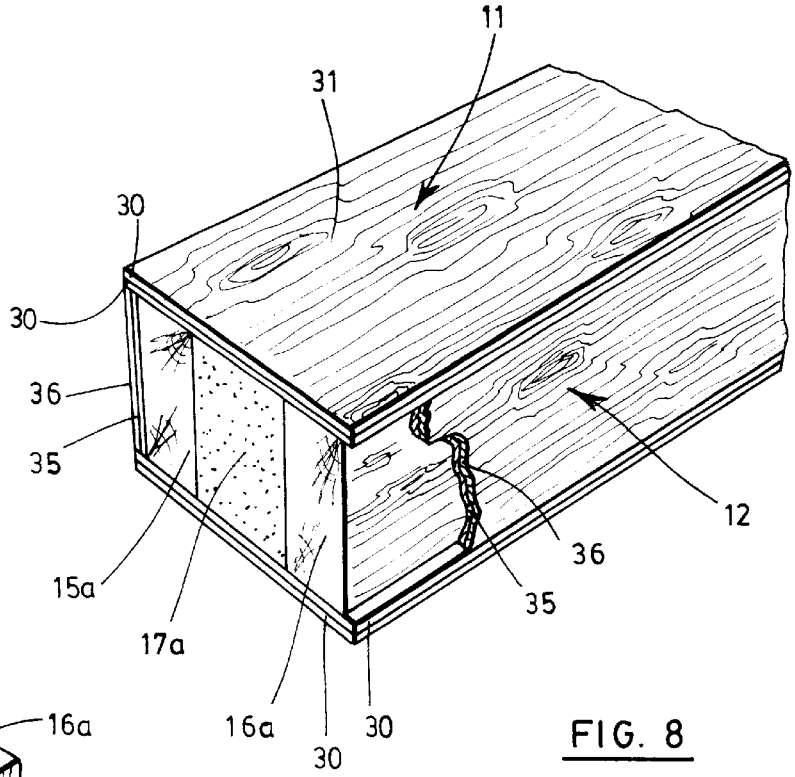
FIG. 8 is the same view as shown in FIG. 6 but of the other embodiment of the invention wherein the side zones and the spacer zone face both of the broad sides of the handle rather than the narrow sides.
Figure 9:
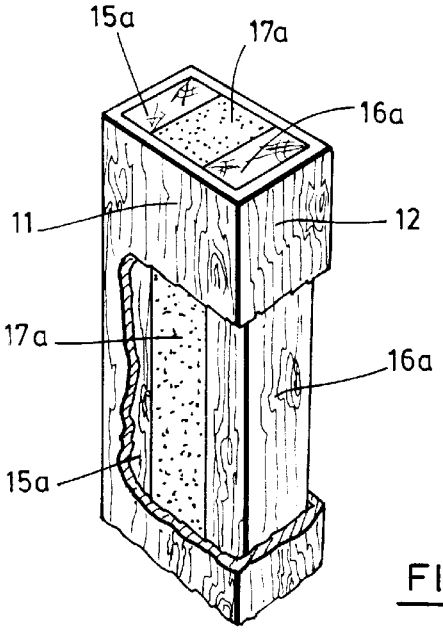
FIG. 9 is the same view as shown in FIG. 2 but of the other embodiment of the invention wherein the side zones and the spacer zone face both of the broad sides of the handle rather than the narrow sides.

Referring to FIGS. 7, 8 and 9, these figures illustrate another example embodiment of a handle component of the present invention. For this variation or modification the spacer zone and the side zones face together each face the broad side of the handle rather than the narrow side. The handle component of these figures may be used to replace the handle component shown in FIGS. 2 to 6, i.e. with appropriate tapering of all three zones in the area of the forward end portion.

Referring to FIG. 7, this figure shows a cross sectional profile of the alternate sandwich member (i.e. perpendicularly to the length of the sandwich member).

The zones are shown as having a common thickness 25*a*. The side zones 15*a* and 16*a* are also shown as having widths 26*a* and 27*a* which are also more or less the same. The spacer zone 17*a* has a width 28*a* which is larger than the individual thickness of either of the side zones. The combined widths of the zones defines the width of the sandwich member. The widths can vary in analogous fashion as discussed above with respect to the thicknesses of the zones for the sandwich members illustrated in FIGS. 2 to 6.

A sandwich member such as shown in FIGS. 7, 8 and 9 also has a pair of opposed broad sides and a pair of opposed narrow sides. The side zones each on their respective own (i.e. individually) define a respective narrow side of the sandwich member, i.e. the side zones each face a corresponding narrow side of the handle component. Similarly, the side zones and the spacer zone together define each of the broad sides of the sandwich member, i.e. the side zones and the spacer zone together each face the corresponding broad sides of the handle component.

Figure 10:
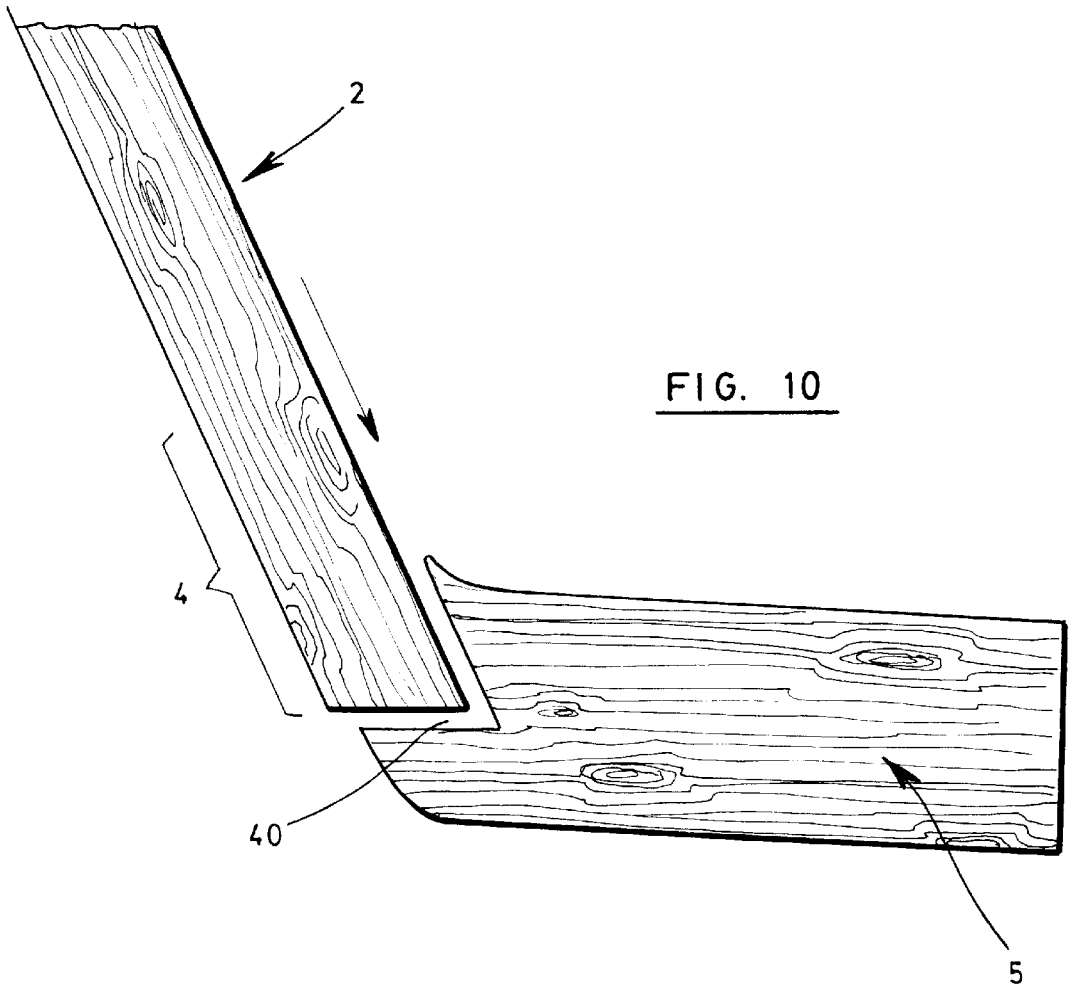
FIG. 10 is a schematic view of a handle component of the present invention in the process of being attached to a blade component.

Turning to FIG. 10 this figure illustrate a handle component 2 and a blade component in the process of being fixed together. As may be seen the blade at a heel part thereof is provided with a notch opening 40 configured to seat the forward end portion 4 of the handle component. The end portion 4 of the handle once seated in the notch 40 may be attached to the blade 2 by a fibre reinforced plastics material layer in any known manner.

Figure 11:
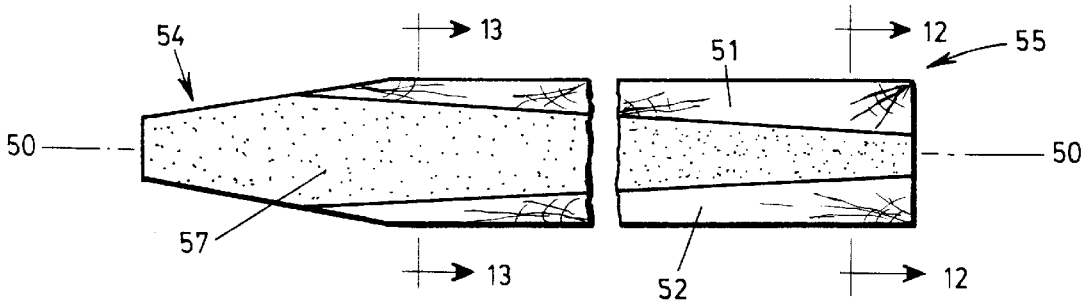
FIG. 11 is a schematic cross sectional view along longitudinal axis of another example embodiment of a sandwich member of the present invention wherein the spacer zone is wedge shaped towards the rear end.
Figure 13:
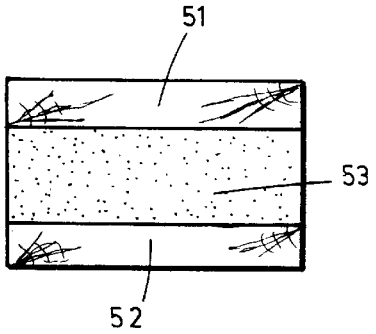
FIG. 13 is a cross-sectional view along 13—13 of the sandwich member shown in FIG. 11.
Figure 12:
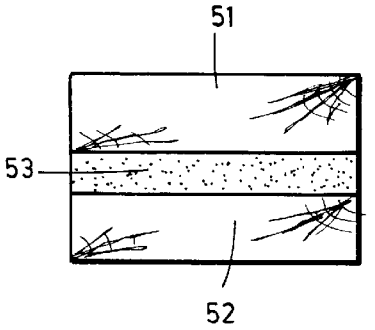
FIG. 12 is a cross-sectional view along 12—12 of the sandwich member shown in FIG. 11.

Referring to FIGS. 11, 12 and 13, these figures illustrate another example embodiment of a sandwich member. The sandwich member is shown in FIG. 11 in longitudinal cross section, i.e. with a longitudinal axis 50. The sandwich member has wood side zones 51 and 52 disposed about a central spacer zone 53. As may be seen the spacer zone has a wedge like configuration extending in the direction from the forward end 54 towards the rear end 55, i.e. the thickness of the spacer zone diminishes towards the rear end 55 as may be appreciated from FIGS. 12 and 13. This type of construction may be used for example if it is desired to shift the centre of gravity of the handle towards the rear end of the handle.

Figure 14:
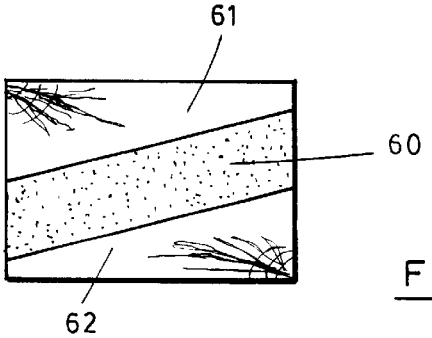
FIG. 14 is a cross-sectional view of a further embodiment of a sandwich member of the present invention wherein the spacer member is diagonally disposed.

FIG. 14 shows another possible configuration for the sandwich member. As shown, for this version the central spacer zone 60 disposed between the side zones 61 and 62 has a cross section aspect which is of a non-rectangular parallelogram type over the longitudinal length of the handle; in contrast the FIGS. 3 and 4 for example show a spacer zone having a non-rectangular parallelogram aspect.

Figure 15:
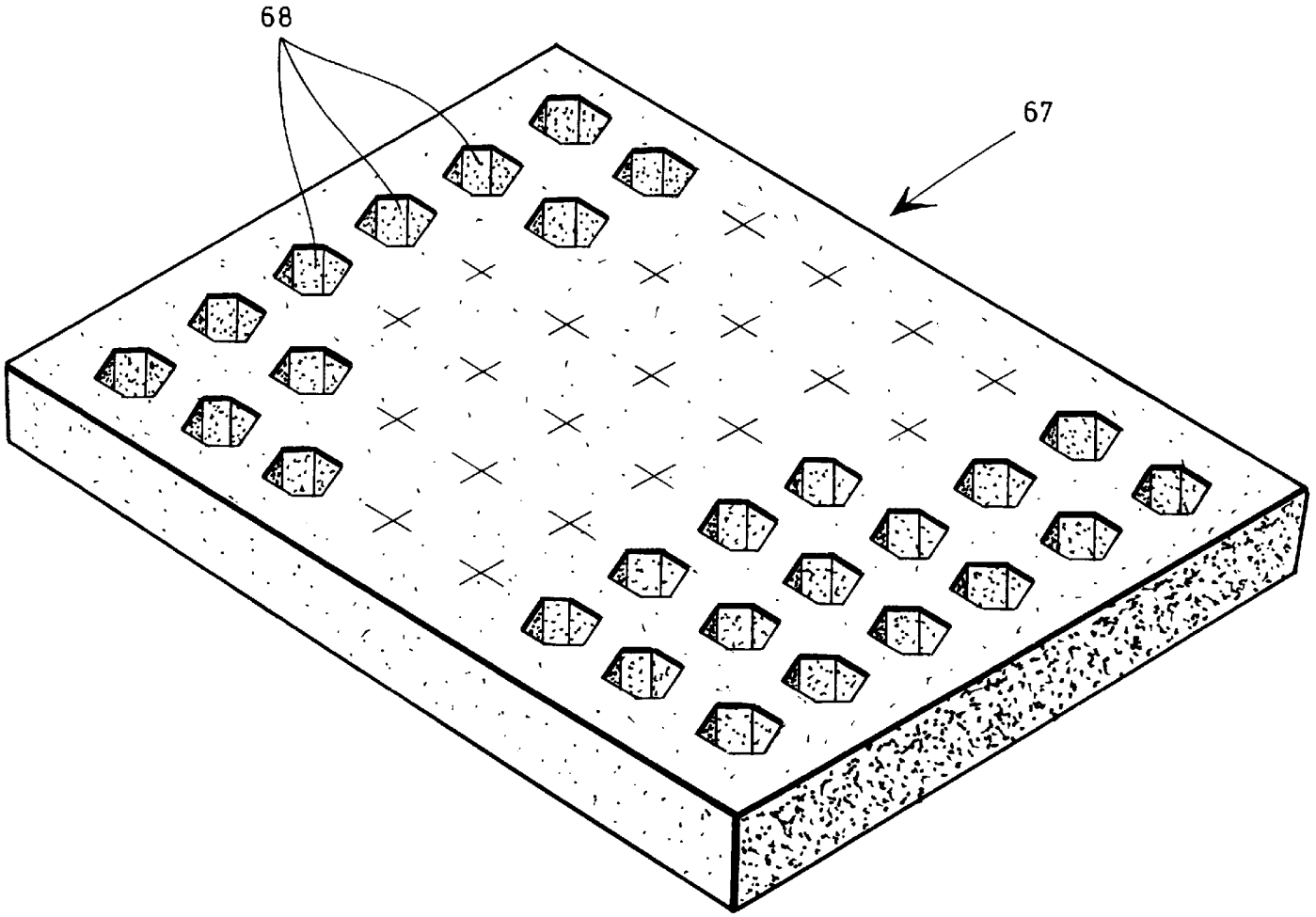
FIG. 15 is a schematic perspective side view of an example embodiment of a spacer body, for a spacer zone, having a honey-comb like structure.

FIG. 15 is a schematic perspective side view of an example embodiment of a rigid foam spacer body for a spacer zone, the spacer body 67 having a honey-comb like structure. As may be seen the spacer body is provides with a plurality of hexagonally shaped openings which extend from one side to the other of the spacer body; only a few of the opening are actually shown, one of which is designated with the reference numeral 68. The provision of the openings may be used as a mechanism to vary the density of the spacer zone.

Although the present invention has been described herein by way of a preferred embodiment thereof, it should be pointed out that any modifications to this preferred embodiment within the scope of the appended claims is not deemed to alter or change the nature and scope of the present invention.

The embodiments of the invention in which an exclusive property or privilege is claimed are as follows:

1. In a hockey stick handle having a pair of opposed narrow sides, a pair of opposed broad sides, a rear end portion a forward end portion, and a longitudinal axis passing through said end portions; said forward end portion being configured for engaging a blade, the improvement wherein the handle comprises a longitudinally extending sandwich composite member, said sandwich member comprising three longitudinally extending substance zones, said substance zones comprising a rigid plastic foam spacer zone and two wood side zones, said side zones being spaced apart by said spacer zone, said three substance zones being configured and disposed such that each side zone individually faces a respective side of one of the pairs of opposed sides of the handle and such that together the two side zones and the spacer zone each face both of the sides of the other of said pairs of opposed sides of the handle; wherein reinforcing means is sheathed about said sandwich member and wherein each side zone faces a respective broad side of said pair of opposed broad sides and wherein said two side zones and said spacer zone together each face both of the narrow sides of said pair of opposed narrow sides.

2. A handle as defined in claim 1 wherein said sandwich member extends from the rear end portion to the forward end portion of said handle and has, from the rear end portion up to the forward end portion of said handle, an essentially constant cross sectional profile perpendicular to said longitudinal axis.

3. A handle as defined in claim 1 wherein the side zones and the spacer zone are configured and disposed such that the spacer zone has a longitudinally extending wedge like shape.

4. A handle as defined in claim 3 wherein said spacer zone diminishes in thickness in the direction from the forward end portion toward the rear end portion.

5. In a game stick comprising an elongated handle component and a blade component, said elongated handle component comprising a pair of opposed narrow sides, a pair of opposed broad sides, a rear end, a forward end portion, and a longitudinal axis passing through said rear end and said forward end portion; said blade component being attached to the forward end portion of said handle component, the improvement wherein the handle comprises a longitudinally extending sandwich composite member, said sandwich member comprising three longitudinally extending substance zones, said substance zones comprising a rigid plastic foam spacer zone and two wood side zones, said side zones being spaced apart by said spacer zone, said three substance zones being configured and disposed such that each side zone individually faces a respective side of one of the pairs of opposed sides of the handle and such that together the two side zones and the spacer zone each face both of the sides of the other of said pairs of opposed sides of the handle; wherein reinforcing means is sheathed about said sandwich member, and wherein each side zone faces a respective broad side of said pair of opposed broad sides and wherein said two side zones and said spacer zone together each face both of the narrow sides of said pair of opposed narrow side.

6. A stick as defined in claim 5 wherein said sandwich member extends from the rear end to the forward end portion of said handle and has, from the rear end up to the forward end portion of said handle, an essentially constant cross sectional profile perpendicular to said longitudinal axis.

7. A handle as defined in claim 5 wherein the side zones and the spacer zone are configured and disposed such that the spacer zone has a longitudinally extending wedge like shape.

8. A handle as defined in claim 7 wherein said spacer zone diminishes in thickness in the direction from the forward end portion toward the rear end.

9. In a hockey stick handle having a pair of opposed narrow sides, a pair of opposed broad sides, a rear end portion, a forward end portion, and a longitudinal axis passing through said end portion, said forward end portion being configured for engaging a blade, the improvement wherein the handle comprises a longitudinally extending sandwich composite member, said sandwich member consists of three longitudinally extending substance zones, said substance zones comprising a rigid plastic foam spacer zone and two wood side zones, said side zones being spaced apart by said spacer zone, said three substance zones being configured and disposed such that each side zone individually faces a respective side of one of the pairs of opposed sides of the handle and such that together the two side zones and the spacer zone each face both of the sides of the other of said pairs of opposed sides of the handle; wherein reinforcing means is sheathed about said sandwich member; and wherein each side zone faces a respective broad side of said pair of opposed broad sides and wherein said two side zones and said spacer zone together each face both of the narrow sides of said pair of opposed narrow side.

10. A handle as defined in claim 9 wherein said sandwich member extends from the rear end portion to the forward end portion of said handle and has, from the rear end portion up to the forward end portion of said handle, an essentially constant cross sectional profile perpendicular to said longitudinal axis.

11. A handle as defined in claim 9 wherein the side zones and the spacer zone are configured and disposed such that the spacer zone has a wedge like shape.

12. A handle as defined in claim 11 wherein said spacer zone diminishes in thickness in the direction from the forward end portion toward the rear end portion.

13. In a game stick comprising:

an elongated handle component and a blade component said elongated handle component comprising a pair of opposed narrow sides, a pair of opposed broad sides, a rear end, a forward end portion, and a longitudinal axis passing through said rear end and said forward end portion, said blade component being attached to the forward end portion of said handle component, the improvement wherein the handle comprises a longitudinally extending sandwich composite member, said sandwich member consists of three longitudinally extending substance zones, said substance zones comprising a rigid plastic foam spacer zone and two wood side zones, said side zones being spaced apart by said spacer zone, said three substance zones being configured and disposed such that each side zone individually faces a respective side of one of the pairs of opposed sides of the handle and such that together the two side zones and the spacer zone each face both of the sides of the other of said pairs of opposed sides of the handle and wherein reinforcing means is sheathed about said sandwich member and wherein each side zone faces a respective broad side of said pair of opposed broad sides and wherein said two side zones and said spacer zone together each face both of the narrow sides of said pair of opposed narrow side.

14. A stick as defined in claim 13 wherein said sandwich member extends from the rear end to the forward end portion of said handle and has, from the rear end up to the forward end portion of said handle, an essentially constant cross sectional profile perpendicular to said longitudinal axis.

15. A handle as defined in claim 13 wherein the side zones and the spacer zone are configured and disposed such that the spacer zone has a longitudinally extending wedge like shape.

16. A handle as defined in claim 15 wherein said spacer zone diminishes in thickness in the direction from the forward end portion toward the rear end.

* * * * *